US007942627B2

(12) United States Patent
Jin

(10) Patent No.: US 7,942,627 B2
(45) Date of Patent: May 17, 2011

(54) AXIAL FAN UNIT

(75) Inventor: Motoi Jin, Kiryu (JP)

(73) Assignee: Nidec Servo Corporation, Gumma (JP)

( * ) Notice: Subject to any disclaimer, the term of this patent is extended or adjusted under 35 U.S.C. 154(b) by 71 days.

(21) Appl. No.: 12/468,935

(22) Filed: May 20, 2009

(65) Prior Publication Data

US 2009/0226299 A1 Sep. 10, 2009

Related U.S. Application Data

(63) Continuation of application No. PCT/JP2007/072563, filed on Nov. 21, 2007.

(30) Foreign Application Priority Data

Nov. 22, 2006 (JP) ..... 2006-314915

(51) Int. Cl.
*F04D 25/16* (2006.01)
*F04D 29/54* (2006.01)

(52) U.S. Cl. ..... 415/66; 415/199.4; 415/209.1

(58) Field of Classification Search ..... 415/66, 415/199.4, 199.5, 209.1, 220
See application file for complete search history.

(56) References Cited

U.S. PATENT DOCUMENTS 4,603,271 A 7/1986 Maruyama et al.
6,244,818 B1 * 6/2001 Chang ..... 415/208.2
6,508,621 B1 1/2003 Zeighami et al.
6,663,342 B2 12/2003 Huang et al.
6,799,942 B1 * 10/2004 Tzeng et al. ..... 415/61
7,014,420 B2 3/2006 Chang
7,238,004 B2 * 7/2007 Lin et al. ..... 415/199.4
2008/0138201 A1 * 6/2008 Lin et al. ..... 415/211.2
2009/0060732 A1 * 3/2009 Hsu et al. ..... 415/208.1

FOREIGN PATENT DOCUMENTS

JP 54-169808 U 11/1979
JP 11-264396 A 9/1999
JP 3717803 B2 11/2005

OTHER PUBLICATIONS

Official Communication issued in International Patent Application No. PCT/JP2007/072563, mailed on Jan. 8, 2008.

* cited by examiner

*Primary Examiner* — Nathaniel Wiehe
(74) *Attorney, Agent, or Firm* — Keating & Bennett, LLP

(57) ABSTRACT

A serial axial fan unit includes a first axial fan arranged to rotate about a central axis, a flow control device connected to the first axial fan along the central axis, and a second axial fan connected to the flow control device along the central axis. The flow control device preferably includes a wind tunnel portion, a base portion, and a plurality of flow control vanes. A flow of air caused by rotation of first blades has a whirl velocity component in substantially the same direction as the rotation direction thereof. This whirl velocity component is converted to a velocity component in a direction parallel or substantially parallel to the central axis by interference of first stationary vanes. The above arrangement provides an improvement in air volume characteristics of a serial axial fan unit including two axial fans arranged in series.

11 Claims, 4 Drawing Sheets

AXIAL FAN UNIT

BACKGROUND OF THE INVENTION

1. Field of the Invention

The present invention relates to an axial fan unit including two axial fans arranged in series.

2. Description of the Related Art

Electronic devices such as personal computers or servers commonly include a cooling fan to cool electronic components contained in a case thereof. As high-density mounting of the electronic components inside the case advances, improved performance of such cooling fans has been demanded. In particular, for use in comparatively large electronic devices such as servers, cooling fans that produce an air flow with high static pressure and high air volume have been desired.

An exemplary technique for achieving increased static pressure in cooling fans is to arrange two axial fans in series to form a fan unit. For example, Japanese Patent No. 3,717,803 discloses a configuration of two impellers arranged in series in an axial direction along a rotation axis.

However, such conventional serial axial fan units suffer a problem of decreased air volume and static pressure, as energy loss occurs when a flow of air produced by the upstream fan enters into the downstream fan.

In the case of a serial axial fan unit including two axial fans with the same air volume and static pressure characteristics arranged in series along the rotation axis (i.e., the two axial fans are substantially coaxial with each other), for example, a maximum static pressure (i.e., a static pressure when the air volume is zero) is expected to be twice as high as it is when there is only one axial fan. In practice, however, the maximum static pressure is only about 1.5 times as high, and experiments have shown that, even with stationary vanes provided between the upstream fan and the downstream fan, the maximum static pressure is only about 1.8 times as high.

In conventional serial axial fan units, the upstream fan and the downstream fan are arranged to rotate in the same direction. In this case, velocity components of the air flowing from the upstream fan toward the downstream fan include a whirl component, i.e., a velocity component in the same direction as that of rotation of the upstream fan. This means that the air flowing into the downstream fan has velocity components including a whirl component in the same direction as that of rotation of the downstream fan. This means that a rotation speed of the downstream fan relative to the flow of the air decreases, resulting in a failure of the downstream fan to act on the air to a sufficient degree. This can be considered to be a factor in the failure to sufficiently improve the static pressure characteristics.

In the serial axial fan unit disclosed in Japanese Patent No. 3,717,803 the downstream fan and the upstream fan are arranged to rotate in different directions. As such, this serial axial fan unit is not designed to allow the downstream fan to perform a sufficient job on the flow of the air caused by the rotation of the upstream fan when the downstream fan and the upstream fan rotate in the same direction.

SUMMARY OF THE INVENTION

In order to overcome the problems described above, preferred embodiments of the present invention provide a serial axial fan unit including first impeller including a plurality of first blades arranged side-by-side in a circumferential direction to be centered about a central axis; a first motor portion arranged to rotate the first impeller; a second impeller including a plurality of second blades arranged side-by-side in the circumferential direction to be centered about the central axis, the second impeller being arranged in series with the first impeller along the central axis; a second motor portion arranged to rotate the second impeller; a flow control device arranged between the first impeller and the second impeller; and a housing arranged to surround the first impeller and the second impeller to define a path for a flow of air. Rotation of the first impeller and rotation of the second impeller cause the air to flow in substantially the same direction. The flow control device preferably includes a plurality of flow control vanes. Each of the flow control vanes has a first edge arranged on the first impeller side and a second edge arranged on the second impeller side. The first edge has a portion arranged downstream of the second edge with respect to a rotation direction of the second impeller.

According to another preferred embodiment of the present invention, there is provided a serial axial fan unit including a first impeller including a plurality of first blades arranged side-by-side in a circumferential direction to be centered about a central axis, the first blades extending radially outward; a first motor portion arranged to rotate the first impeller about the central axis; a second impeller including a plurality of second blades arranged side-by-side in the circumferential direction to be centered about the central axis, the second blades extending radially outward, the second impeller being arranged in series with the first impeller along the central axis; a second motor portion arranged to rotate the second impeller about the central axis; a flow control device arranged between the first impeller and the second impeller; and a housing arranged to surround the first impeller and the second impeller to define a path for a flow of air. Rotation of the first impeller and rotation of the second impeller cause the air to flow in substantially the same direction. The flow control device includes a plurality of flow control vanes. The plurality of flow control vanes are arranged to impart a flow velocity component in a direction opposite to a direction of the rotation of the second impeller to the flow of the air caused by the rotation of the first impeller.

In the serial axial fan units according to preferred embodiments of the present invention, the flow control device imparts, to the flow of the air caused by the rotation of the first impeller, a whirl component directed upstream with respect to the rotation direction of the second impeller. This results in an increased rotation speed of the second impeller relative to the flow of the air entering into the second impeller. This allows the second impeller to provide sufficient energy to the flow of the air, resulting in increased static pressure energy. Thus, the serial axial fan units according to preferred embodiments of the present invention are capable of exhibiting excellent static pressure characteristics.

Other features, elements, steps, characteristics and advantages of the present invention will become more apparent from the following detailed description of preferred embodiments of the present invention with reference to the attached drawings.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
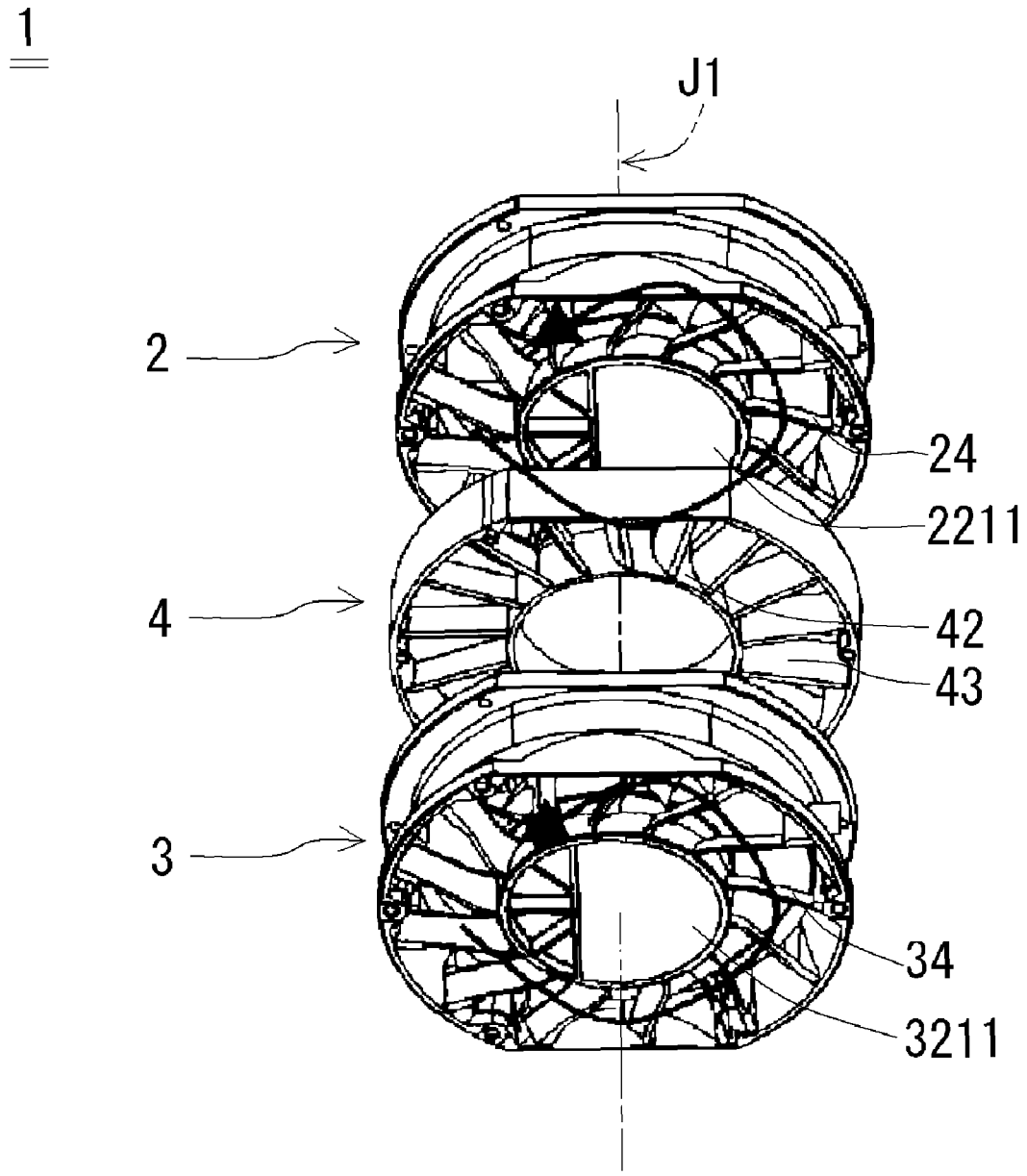
FIG. 1 is an exploded perspective view of a serial axial fan unit according to a preferred embodiment of the present invention.
Figure 2:
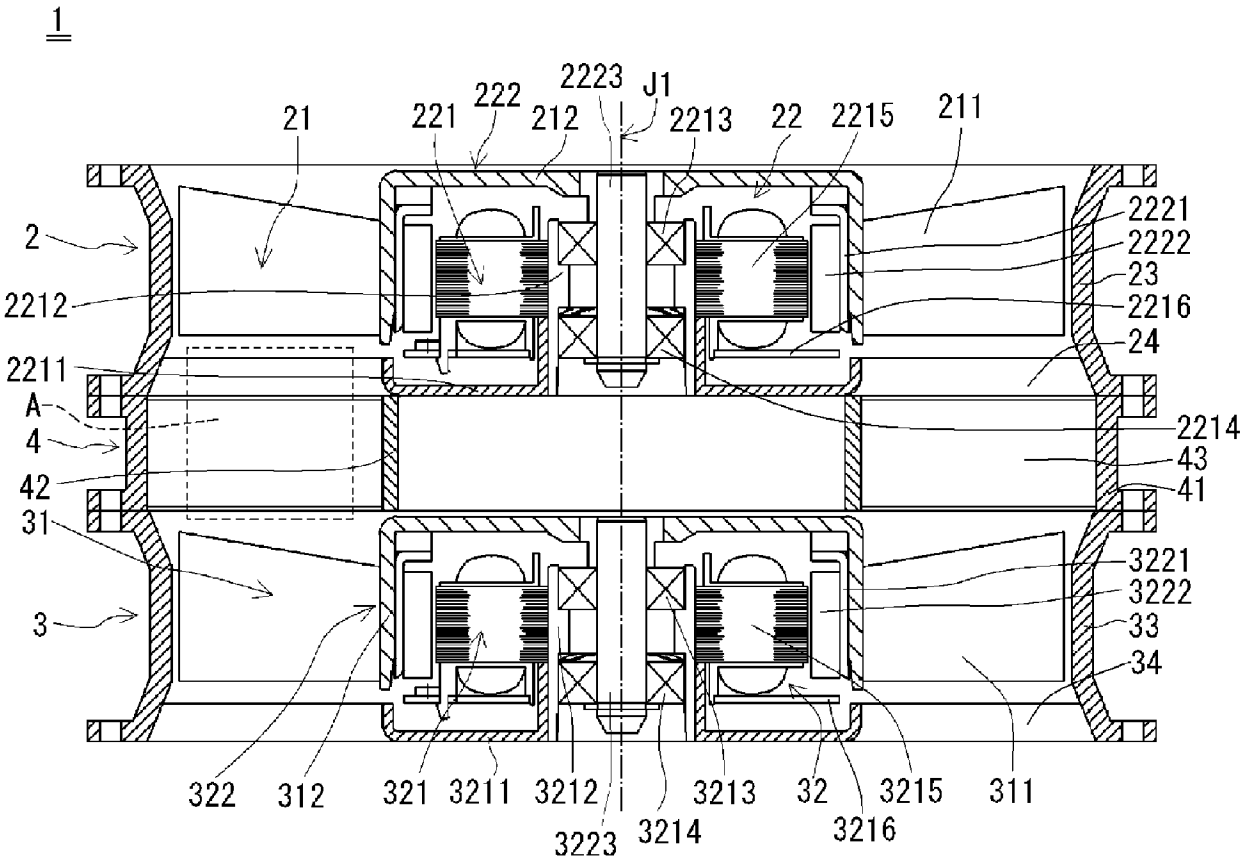
FIG. 2 is a vertical cross-sectional view of the serial axial fan unit according to a preferred embodiment of the present invention, taken along a plane including a central axis.

FIG. 1 is an exploded perspective view of a serial axial fan unit 1 according to a preferred embodiment of the present invention. FIG. 2 is a vertical cross-sectional view of the serial axial fan unit 1 taken along a plane including a central axis. The serial axial fan unit 1 is used, for example, as an electric cooling fan device for air-cooling an electronic device such as, for example, a server. As illustrated in FIGS. 1 and 2, the serial axial fan unit 1 includes a first axial fan 2, which is arranged at the top in FIG. 1; a flow control device 4, which is connected to the first axial fan 2 along a central axis J1 and arranged in the middle in FIG. 1; and a second axial fan 3, which is connected to the flow control device 4 along the central axis J1 and arranged at the bottom in FIG. 1. The first axial fan 2, the flow control device 4, and the second axial fan 3 are secured to one another through screws or the like (not shown).

In the serial axial fan unit 1 according to the present preferred embodiment, a first impeller 21 in the first axial fan 2 and a second impeller 31 in the second axial fan 3 as illustrated in FIG. 2 are arranged to rotate in the same direction about the central axis J1, so that air is taken in from an upper side in FIG. 2 (i.e., from above the first axial fan 2) and sent downward (i.e., toward and eventually out of the second axial fan 3), resulting in a flow of the air parallel or substantially parallel to the central axis J1. In more detail, the first impeller 21 in the first axial fan 2 and the second impeller 31 in the second axial fan 3 are preferably arranged to rotate about the central axis J1 clockwise as viewed from above in FIG. 2. In the following description, the terms "axial direction", "axial", and "axially" refer to a direction parallel or substantially parallel to a rotation axis as appropriate, whereas the terms "radial direction", "radial", and "radially" refer to a direction perpendicular or substantially perpendicular to the rotation axis as appropriate. Moreover, as to the directions parallel or substantially parallel to the central axis J1, the upper side in FIG. 2 where the air is taken into the serial axial fan unit 1 will be referred to as an "upper side" or "inlet side" as appropriate, whereas the lower side in FIG. 2 where the air exits the serial axial fan unit 1 will be referred to as a "lower side" or "outlet side" as appropriate. Note that the central axis J1 can extend in any desirable direction, and may not necessarily extend in the direction of gravity.

The first axial fan 2 preferably includes the first impeller 21, a first motor portion 22, a first housing portion 23, and a plurality of first stationary vanes 24. The first stationary vanes 24 define first support ribs. The first impeller 21 includes a plurality of first blades 211, which extend radially outward to be centered about the central axis J1. The first blades 211 are preferably arranged at regular intervals in a circumferential direction to be centered about the central axis J1. In the present preferred embodiment, the number of first blades 211 is preferably five, but any desirable number of first blades 211 could be included. The first motor portion 22 is arranged to cause the first impeller 21 to rotate clockwise about the central axis J1 as viewed from above in FIG. 2. This causes the flow of the air to be parallel or substantially parallel with the central axis J1 (i.e., the flow of the air from the upper side to the lower side in FIG. 2). The first housing portion 23 is positioned radially outward of the first impeller 21 to surround the first impeller 21, and thereby defines a path for the flow of the air caused by the rotation of the first impeller 21 about the central axis J1. The plurality of first stationary vanes 24, arranged below the first impeller 21 (i.e., between the first impeller 21 and the flow control device 4), extend from the first motor portion 22 radially outward to be centered about the central axis J1, and are connected to the first housing portion 23 to support the first motor portion 22. In the present preferred embodiment, the number of first stationary vanes 24 is preferably seventeen, but any desirable number of first stationary vanes 24 could be used. A set of these seventeen first stationary vanes 24 will sometimes be referred to collectively as a "first stationary vane set" as appropriate. In the first axial fan 2, the first impeller 21, the first motor portion 22, and the first stationary vane set are arranged inside the first housing portion 23. In the description of the present preferred embodiment, support ribs that produce an effect of stationary vanes described below are referred to as "stationary vanes" for the sake of convenience.

Note that, in FIG. 2, both the first blades 211 and the first stationary vanes 24 are illustrated only in outline as viewed from one side. As with the first blades 211 and the first stationary vanes 24, second blades 311 and second stationary vanes 34 of the second axial fan 3 described below are also illustrated only in outline as viewed from one side.

As illustrated in FIG. 2, the first motor portion 22 includes a stationary assembly 221 and a rotor portion 222. The rotor portion 222 defines a rotating assembly. The rotor portion 222 is supported by a bearing mechanism described below to be rotatable about the central axis J1 with respect to the stationary assembly 221.

The stationary assembly 221 preferably includes a base portion 2211, which is substantially disc-shaped with the central axis J1 as its center in a plan view seen from above in FIG. 2. The base portion 2211 is fixed to an inner circumferential surface, which is substantially cylindrical, of the first housing portion 23 through the plurality of first stationary vanes 24 to support each portion of the stationary assembly 221. The base portion 2211 is preferably made of aluminum, and is produced, for example, by die casting together with the plurality of first stationary vanes 24 and the first housing portion 23, which are also preferably made of aluminum. Note that the material and production method used for the base portion 2211, the first stationary vanes 24, and the first housing portion 23 are not limited to aluminum and die casting. For example, they may also be made of a resin material (or plastic, or any other suitable polymeric material, hereinafter simply referred to as a resin) and produced by injection molding in other preferred embodiments of the present invention.

As illustrated in FIG. 2, a bearing support portion 2212 is fixed in a center of the base portion 2211. The bearing support portion 2212 is substantially cylindrical and protrudes upward (i.e., toward the inlet side) from the base portion 2211. Ball bearings 2213 and 2214, which define a portion of the bearing mechanism, are provided inside the bearing support portion 2212. The ball bearings 2213 and 2214 are preferably spaced apart from each other in the axial direction.

The stationary assembly 221 preferably includes an armature 2215 and a circuit board 2216. The armature 2215 is attached to an outer side surface of the bearing support portion 2212. The circuit board 2216 is substantially annular and flat, and is arranged below the armature 2215 and has a circuit that is electrically connected to the armature 2215 and designed to control rotation of the rotor portion 222. The circuit board 2216 is connected to an external power supply through a set of lead wires arranged in a bundle. The external power supply is preferably external to the serial axial fan unit 1. Note that the set of lead wires and the external power supply are not shown in FIG. 2.

The rotor portion 222 includes a yoke 2221, a field magnet 2222, and a shaft 2223. The yoke 2221 is preferably made of magnetic metal and arranged substantially cylindrically with the central axis J1 as its center. The field magnet 2222 is substantially cylindrical and secured to an inside (i.e., an inner side surface) of a side wall portion of the yoke 2221 to be radially opposed to the armature 2215. The shaft 2223 is concentric with the central axis J1 and protrudes downward from a center of a hub 212, which will be described below.

The shaft 2223 is inserted in the bearing support portion 2212, and supported by the ball bearings 2213 and 2214 to be rotatable with respect to the stationary assembly 221. In the first axial fan 2, the shaft 2223 and the ball bearings 2213 and 2214 play the role of the bearing mechanism to support the yoke 2221 to be rotatable about the central axis J1 with respect to the base portion 2211.

The first impeller 21 preferably includes the hub 212 and the plurality of first blades 211. The hub 212 is substantially in the shape of a covered cylinder, and is arranged to cover an outer side of the yoke 2221 of the first motor portion 22. The first blades 211 extend radially outward from an outside (i.e., an outer side surface) of a side wall portion of the hub 212, and arranged side-by-side in the circumferential direction to be centered about the central axis J1. The hub 212 is preferably made of resin, and produced by, for example, injection molding together with the first blades 211, which are also made of resin.

In the first axial fan 2, drive current is applied to the armature 2215 to produce a torque centered on the central axis J1 between the armature 2215 and the field magnet 2222. Moreover, the drive current applied to the armature 2215 is controlled by the circuit provided in the circuit board 2216 of the first motor portion 22 so that the plurality of first blades 211 of the first impeller 21 attached to the rotor portion 222 rotate at a predetermined rotation rate about the central axis J1 clockwise as viewed from above in FIG. 2. This results in an intake of the air from the upper side (i.e., the inlet side) in FIG. 2 and exit of the air toward the lower side (i.e., the outlet side). In the present preferred embodiment, the rotation rate is set to approximately 3000 rpm, for example.

The second axial fan 3 preferably includes the second impeller 31, a second motor portion 32, a second housing portion 33, and the plurality of second stationary vanes 34. The second stationary vanes 34 define second support ribs. The second impeller 31 includes the plurality of second blades 311, which extend radially outward to be centered about the central axis J1. The plurality of second blades is preferably arranged at regular intervals in the circumferential direction to be centered about the central axis J1. In the present preferred embodiment, the number of second blades 311 is preferably five, but any desired number of second blades 311 could be used. The second motor portion 32 is arranged to cause the second impeller 31 to rotate about the central axis J1 clockwise as viewed from above in FIG. 2. This causes the flow of the air to be parallel or substantially in parallel with the central axis J1 (i.e., the flow of the air from the upper side to the lower side in FIG. 2). The second housing portion 33 is positioned radially outward of the second impeller 31 to surround the second impeller 31, and thereby defines a path for the flow of the air caused by the rotation of the second impeller 31 about the central axis J1. The plurality of second stationary vanes 34, arranged below the second impeller 31, extend from the second motor portion 32 radially outward to be centered about the central axis J1, and are connected to the second housing portion 33 to support the second motor portion 32. In the present preferred embodiment, the number of second stationary vanes 34 is preferably seventeen, but any desired number of stationary vanes 34 could be used. A set of these seventeen second stationary vanes 34 will sometimes be referred to collectively as a "second stationary vane set" as appropriate. In the second axial fan 3, the second impeller 31, the second motor portion 32, and the second stationary vane set are arranged inside the second housing portion 33.

Figure 3:
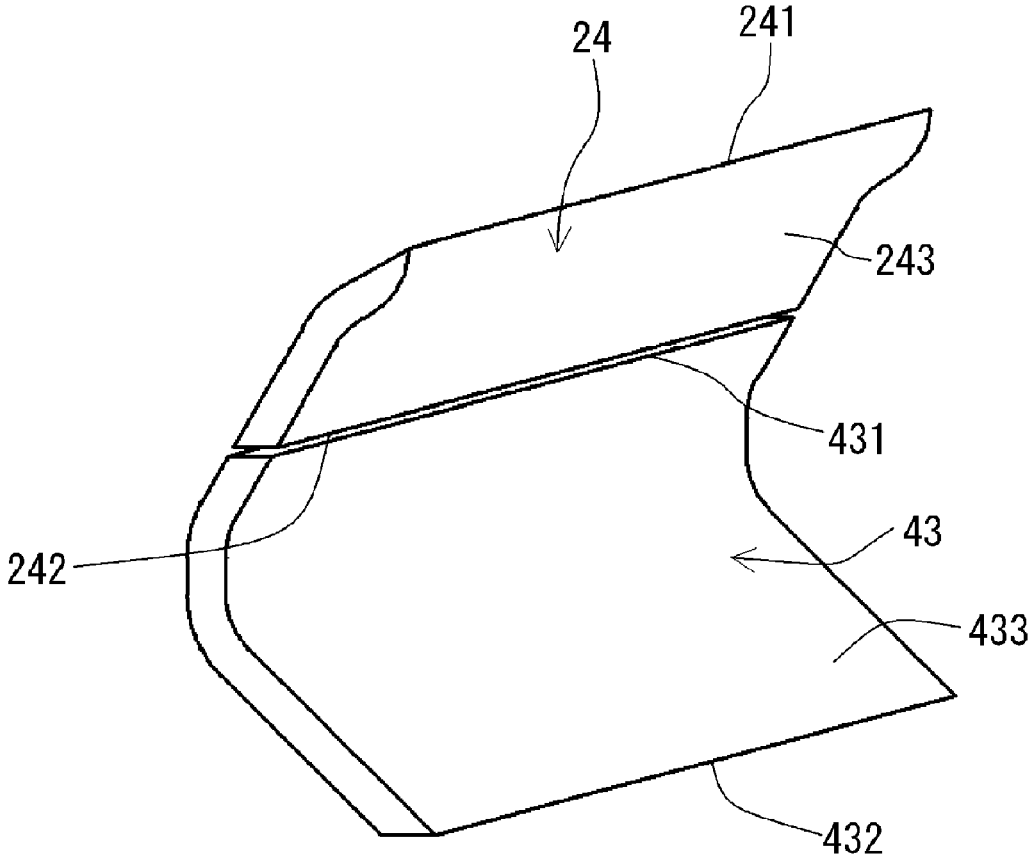
FIG. 3 is a perspective view of portion A of the serial axial fan unit as shown in FIG. 2, where a combination of a first stationary vane and a flow control vane is arranged.

FIG. 3 is a perspective view of portion A of the serial axial fan unit 1 as shown in FIG. 2, where a combination of the first stationary vane 24 and a flow control vane 43 is arranged. Focusing on the serial axial fan unit 1 as a whole, a housing of the serial axial fan unit 1 is defined by the first housing portion 23, a wind tunnel portion 41, and the second housing portion 33, which are arranged continuously, and in the path for the airflow inside the housing of the serial axial fan unit 1, the first impeller 21, the first stationary vane set, the flow control device 4, the second impeller 31, and the second stationary vane set are arranged in that order starting from the upper side (i.e., the inlet side) in FIG. 2. Note that the second stationary vane set is defined by a plurality of stationary vanes independent of the first stationary vane set. In the serial axial fan unit 1, the number of first stationary vanes 24 is preferably equal to the number of second stationary vanes 34.

As illustrated in FIG. 2, the second motor portion 32 is similar in structure to the first motor portion 22, and includes a stationary assembly 321 and a rotor portion 322. The rotor portion 322 is arranged above (i.e., on the inlet side of) the stationary assembly 321, and supported to be rotatable with respect to the stationary assembly 321.

The stationary assembly 321 includes a base portion 3211, a bearing support portion 3212, an armature 3215, and a circuit board 3216. The base portion 3211 is fixed to an inner circumferential surface, which is substantially cylindrical, of the second housing portion 33 through the plurality of second stationary vanes 34 to support each portion of the stationary assembly 321. The bearing support portion 3212 is substantially cylindrical and has ball bearings 3213 and 3214 provided therein. The armature 3215 is attached to an outer circumference of the bearing support portion 3212. The circuit board 3216 is substantially annular and flat, and is arranged below the armature 3215 and has a circuit that is electrically connected to the armature 3215 and designed to control the armature 3215.

The base portion 3211 is preferably made of aluminum, and is produced by the die casting together with the plurality of second stationary vanes 34 and the second housing portion 33, which are also made of aluminum, for example. Note that the material and production method used for the base portion 3211, the second stationary vanes 34, and the second housing portion 33 are not limited to aluminum and die casting. For example, they may be made of a resin material and produced by the injection molding in other preferred embodiments of the present invention. The circuit board 3216 is preferably connected to the external power supply through a set of lead wires in a bundle. The external power supply is external to the serial axial fan unit 1.

The rotor portion 322 includes a yoke 3221, a field magnet 3222, and a shaft 3223. The yoke 3221 is preferably made of magnetic metal and substantially cylindrical with the central axis J1 for its center. The field magnet 3222 is substantially cylindrical and secured to an inside (i.e., an inner side surface) of a side wall portion of the yoke 3221 to be radially opposed to the armature 3215. The shaft 3223 is concentric with the central axis J1 and protrudes downward from a center of a hub 312, which will be described below. The shaft 3223 is inserted in the bearing support portion 3212, and supported by the ball bearings 3213 and 3214 to be rotatable. In the second axial fan 3, the shaft 3223 and the ball bearings 3213 and 3214 play the role of the bearing mechanism arranged to support the yoke 3221 to be rotatable about the central axis J1 with respect to the base portion 3211.

The second impeller 31 includes the hub 312 and the plurality of second blades 311. The hub 312 substantially assumes the shape of a covered cylinder, and covers an outer side of the yoke 3221 of the second motor portion 32. The second blades 311 extend radially outward from an outer side surface of the hub 312, and arranged side-by-side in the circumferential direction to be centered about the central axis J1. The hub 312 is preferably made of resin, and produced, for example, by the injection molding together with the second blades 311, which are also made of resin.

In the second axial fan 3, the second motor portion 32 is driven to cause the plurality of second blades 311 of the second impeller 31 to rotate at the predetermined rotation rate about the central axis J1 clockwise as viewed from above in FIG. 2. This results in intake of the air from the upper side in FIG. 2 (i.e., from the direction of the first axial fan 2) and exit of the air toward the lower side (i.e., toward the second stationary vanes 34). In the present preferred embodiment, the rotation rate is set to approximately 3000 rpm, for example.

In the present preferred embodiment, the two axial fans, i.e., the first and second axial fans 2 and 3, which preferably have the same structure and exhibit the same air volume and static pressure, are used. In addition, the flow control device 4, which will be described below, is arranged between the two axial fans, so that more than twice the value of the static pressure offered by a single axial fan can be exhibited. Moreover, the use of the same axial fans facilitates management of a production line, and contributes to improving productivity. Note, however, that while the first and second axial fans 2 and 3 are arranged to have the same shape considering balance of air volume values, they may have different configurations such as different rotation rates, for example. Also, the first and second axial fans 2 and 3 may have different shapes.

As illustrated in FIG. 2, the flow control device 4 is arranged between the first and second axial fans 2 and 3 along the central axis J1. The flow control device 4 includes the wind tunnel portion 41, a base portion 42, and a plurality of flow control vanes 43.

As illustrated in FIG. 2, the wind tunnel portion 41 is arranged to have an upper end surface that substantially coincides in shape with an outlet-side end surface of the first axial fan 2. The inner circumferential surface of the first housing portion 23 of the first axial fan 2 and an inner circumferential surface of the wind tunnel portion 41 define a continuous surface as a result of joining of the first axial fan 2 and the flow control device 4. As illustrated in FIG. 2, the wind tunnel portion 41 is arranged to have a lower end surface that substantially coincides in shape with an inlet-side end surface of the second axial fan 3. The inner circumferential surface of the second housing portion 33 of the second axial fan 3 and the inner circumferential surface of the wind tunnel portion 41 define a continuous surface as a result of joining of the second axial fan 3 and the flow control device 4. The above arrangements allow the air, exiting the first axial fan 2, to travel smoothly along the inner circumferential surfaces of the first housing portion 23, the wind tunnel portion 41, and the second housing portion 33 and be eventually sent out of the second axial fan 3.

The base portion 42 of the flow control device 4 is substantially cylindrical with the central axis J1 as its center. The plurality of flow control vanes 43 (which are preferably seventeen in number in the present preferred embodiment, and the seventeen flow control vanes 43 will be hereinafter referred to collectively as a "flow control vane set" as appropriate) extend radially outward from an outer side surface of the base portion 42 to be connected to the wind tunnel portion 41, and are arranged side-by-side in the circumferential direction to be centered about the central axis J1. The base portion 42 is preferably made of aluminum, and is produced by die casting together with the plurality of flow control vanes 43 and the wind tunnel portion 41, which are also preferably made of aluminum, for example. Note that the material and production method used for the base portion 42, the flow control vanes 43, and the wind tunnel portion 41 are not limited to aluminum and die casting. For example, they may be made of a resin material and produced by the injection molding in other preferred embodiments of the present invention.

As illustrated in FIG. 3, the first stationary vanes 24 and the flow control vanes 43 are arranged in such a manner that lower end surfaces of the first stationary vanes 24 and upper end surfaces of the flow control vanes 43 substantially coincide with each other when viewed from above in a direction parallel or substantially parallel to the central axis J1. Although FIG. 3 illustrates only one of the plurality of first stationary vanes 24 and a portion of the associated one of the flow control vanes 43, the lower end surfaces of all the first stationary vanes 24 and the upper end surfaces of all the flow control vanes 43 all substantially coincide with each other when viewed from above in the direction parallel or substantially in parallel to the central axis J1.

Figure 4:
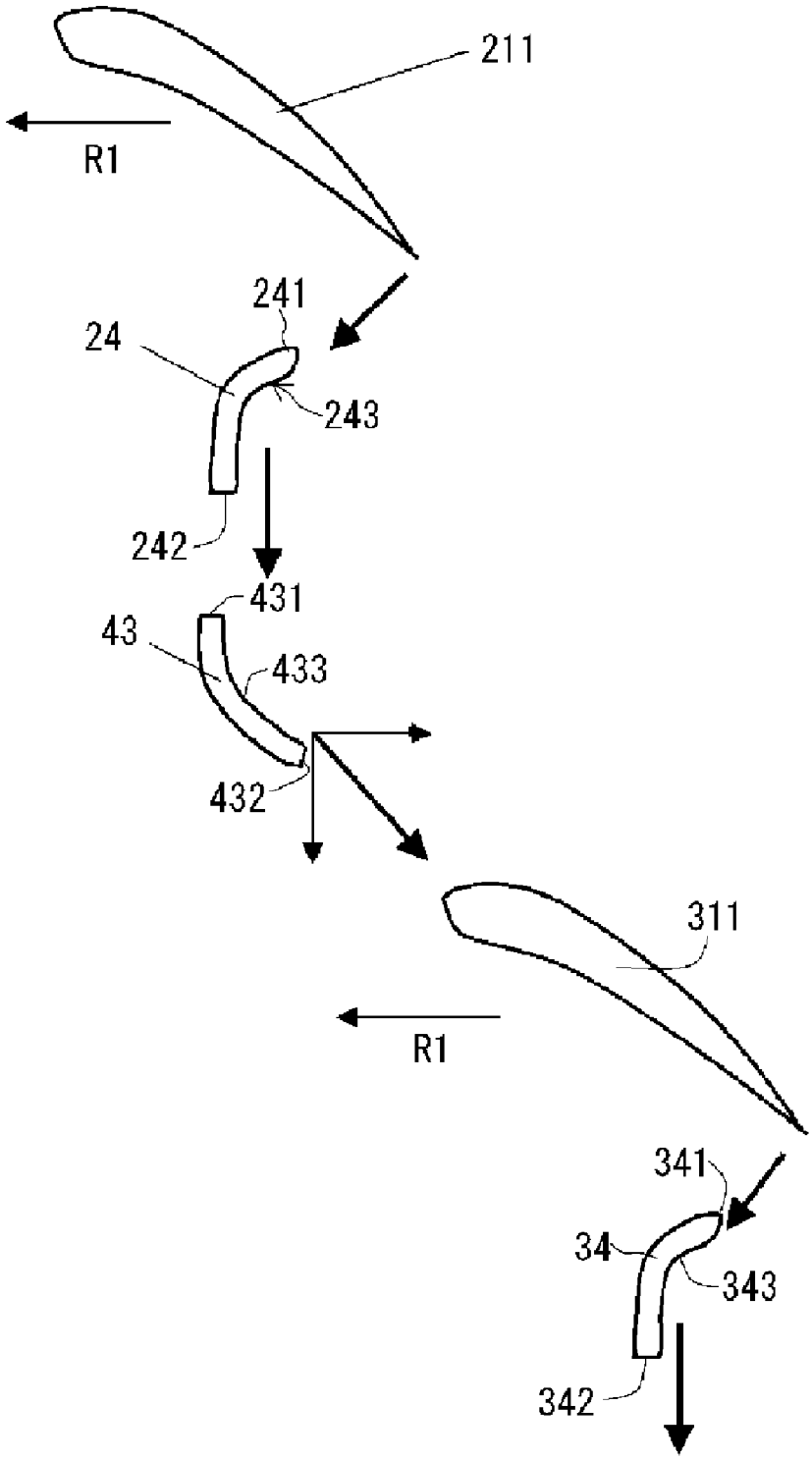
FIG. 4 is an exploded cross-sectional view of a first blade, the first stationary vane, the flow control vane, a second blade, and a second stationary vane, taken along a cylindrical surface with an arbitrary radius centered on the central axis in FIG. 2.

FIG. 4 is an exploded cross-sectional view of the first blade 211, the first stationary vane 24, the flow control vane 43, the second blade 311, and the second stationary vane 34, taken along a cylindrical surface with an arbitrary radius centered on the central axis J1 in FIG. 2. Note that, in FIG. 4, the first stationary vane 24 and the flow control vane 43 are separated from each other to facilitate description.

The first stationary vane 24 preferably has an upper edge 241, which is positioned on the first blade 211 side, and a lower edge 242, which is positioned on the flow control vane 43 side. The upper edge 241 is arranged upstream of the lower edge 242 in a rotation direction R1. This allows a wind receiving surface 243 of the first stationary vane 24 arranged to receive the flow of the air caused by the rotation of the first blade 211 to have a portion slanting to define a curved surface directed toward the outlet side with respect to the central axis J1. This arrangement allows a whirl velocity component, in substantially the same direction as the rotation direction R1, of the flow of the air caused by the rotation of the first blade 211 to be converted to a velocity component in the direction parallel to the central axis J1 by interference of the first stationary vane 24. The term "whirl velocity component" as used hereinafter in the description of the present preferred embodiment will refer to a velocity component in a direction parallel to a tangent to the circumferential direction centered on the central axis J1.

After passing the wind receiving surface 243 of the first stationary vane 24, the air passes a sloping surface 433 of the flow control vane 43, which is arranged so as to be continuous with the first stationary vane 24. The flow control vane 43 preferably has an upper edge 431, which is positioned on the first stationary vane 24 side, and a lower edge 432, which is positioned on the second blade 311 side. The upper edge 431 is arranged downstream of the lower edge 432 in the rotation direction R1 of the first blade 211. This allows the sloping surface 433, which is arranged to receive the air flowing from the wind receiving surface 243, to have a portion slanting to define a curved surface directed toward the inlet side with respect to the central axis J1. This allows a velocity component in the direction parallel or substantially parallel to the central axis J1 of the flow of the air exiting the wind receiving surface 243 to be converted, when the air passes the sloping surface 433, to a whirl velocity component in a direction opposite to the rotation direction R1.

When the first stationary vane 24 and the flow control vane 43 are in an assembled condition, the wind receiving surface 243 and the sloping surface 433 preferably define a smooth combined surface as illustrated in FIG. 3. This arrangement will allow the air flowing across the wind receiving surface 243 to be smoothly sent to the sloping surface 433. The combined surface exhibits a gradual change in a slope angle with respect to the central axis J1 from the wind receiving surface 243 to the sloping surface 433, so that the first stationary vane 24 and the flow control vane 43 can vary the direction of the flow velocity of the flow of the air efficiently.

As illustrated in FIG. 4, the air, traveling along the flow control vane 43 and exiting it toward the lower side, now has a whirl velocity component in an upstream direction with respect to the rotation direction of the second blade 311. This allows the second blade 311 to convert the whirl velocity component of the air flowing from the flow control vane 43 into the second axial fan 3 to a velocity component in the direction parallel or substantially parallel to the central axis J1. The air flowing from the flow control vane 43 into the second axial fan 3 impinges upon a surface of the second blade 311 opposing in a downstream direction with respect to the rotation direction of the second blade 311, so that the whirl velocity component is converted to the velocity component in the direction parallel or substantially parallel to the central axis J1. The direction of the flow velocity of the air exiting the second blade 311 is determined by a combination of the velocity components of the flow of the air, a slope angle with respect to the central axis J1 of the surface of the second blade 311 opposing the downstream direction with respect to the rotation direction of the second blade 311, and a rotation speed thereof. In other words, the direction of the flow velocity is determined by the sum of a vector of the flow of the incoming air and a vector of force applied to the air by the rotating second blade 311.

As illustrated in FIG. 4, the second stationary vane 34 preferably has an upper edge 341, which is positioned on the second blade 311 side, and a lower edge 342, which is positioned on the outlet side. The upper edge 341 is arranged upstream of the lower edge 342 in the rotation direction R1 of the second blade 311. This allows a wind receiving surface 343 of the second stationary vane 34, arranged to receive the flow of the air caused by the rotation of the second blade 311, to have a portion slanting to define a curved surface facing toward the outlet side with respect to the central axis J1. This arrangement allows a whirl velocity component, in substantially the same direction as the rotation direction R1, of the flow of the air caused by the rotation of the second blade 311 to be converted to a velocity component in the direction parallel or substantially parallel to the central axis J1 by interference of the second stationary vane 34.

As described above, the flow of the air caused by the rotation of the impellers 21 and 31 has the whirl velocity component. Nevertheless, the air is sent smoothly from the inlet side toward the outlet side by the efficient conversion of the whirl velocity component to the velocity component in the direction parallel or substantially parallel to the central axis J1. Moreover, the conversion of the whirl velocity component to the velocity component in the direction parallel or substantially parallel to the central axis J1 imparts static pressure energy to the air, resulting in an improvement in a static pressure characteristic of the serial axial fan unit 1. If the whirl velocity component of the air flowing into the second axial fan 3 was directed in the same direction as the rotation direction of the second impeller 31, the second impeller 31 would not be able to apply sufficient pressure to the air. Furthermore, the efficient flow of the air from the inlet side to the outlet side achieved by the above-described arrangements improves efficiency of the serial axial fan unit 1 as a whole. This achieves a reduction in power consumption of the serial axial fan unit 1.

When the direction of the flow velocity of the air flowing from the first axial fan 2 is changed by the plurality of flow control vanes 43, an abrupt change should be avoided. If the direction of the flow velocity is abruptly changed, an eddy might be produced inside the flow of the air due to inertia of the flow of the air working in the direction of the flow velocity thereof. In contrast, when the direction of the flow velocity is changed gradually, it is less likely that an eddy will be produced inside the flow of the air. In order to avoid the abrupt change in the direction of the flow velocity, it is necessary that the slope angle of the flow control vane 43 with respect to the central axis J1 should increase gradually from the inlet side toward the outlet side. In order to achieve this, the flow control vane 43 needs to have a sufficient dimension in the direction parallel or substantially parallel to the central axis J1. The dimension of the flow control vane 43 in the direction parallel or substantially parallel to the central axis J1 is preferably approximately half a dimension of the axial fans 2 and 3 in the direction parallel or substantially parallel to the central axis J1.

After the exit of the air from the first axial fan 2, the static pressure energy of the air tends to decrease with increasing distance of the air from the first axial fan 2. Therefore, it is desirable that an interval, in the direction parallel to the central axis J1, between the first axial fan 2 and the flow control vane 43 should be minimized. Moreover, if a dimension of the flow control vane 43 in the direction parallel or substantially parallel to the central axis J1 is too great, the static pressure energy may decrease while the velocity component of the flow of the air is converted by the flow control vane 43 to the whirl velocity component. Therefore, it is not desirable that the dimension of the flow control vane 43 in the direction parallel or substantially parallel to the central axis J1 be too great. The dimension of the flow control vane 43 in the direction parallel or substantially parallel to the central axis J1 is preferably smaller than that of the axial fans 2 and 3.

In the above-described preferred embodiments, the first and second axial fans 2 and 3 have the first and second stationary vanes 24 and 34, respectively. In other preferred embodiments of the present invention, however, the first and second stationary vanes 24 and 34 may be replaced by support ribs designed simply to connect the base portions 2211 and 3211 to the first and second housing portions 23 and 33, respectively, without producing the effect of the stationary vanes. In this case, a stream of air produced by the rotation of the first impeller 21 travels along the support ribs and flows into the flow control device 4 without the direction of the flow velocity being changed. After flowing into the flow control device 4, the flow of the air stream is converted by the plurality of flow control vanes 43 into a flow of air with a whirl velocity component in the upstream direction with respect to the rotation direction of the second impeller 31. Therefore, even in this case, an improvement in the static pressure characteristic and an air volume characteristic can be achieved, as compared to a serial axial fan unit without the flow control device 4.

Note that, in the above-described preferred embodiments, the first axial fan 2, the second axial fan 3, and the flow control device are independent devices assembled into a unit. In other preferred embodiments of the present invention, however, the first housing portion 23 of the first axial fan 2, the second housing portion 33 of the second axial fan 3, and the wind tunnel portion 41 of the flow control device 4 may be produced as a single integral member.

While the serial axial fan unit 1 has been described in detail above, it will be understood by those skilled in the art that the above-described serial axial fan unit 1 is merely an exemplary, preferred embodiment of the present invention, and that various other shapes and configurations are possible in other embodiments of the present invention insofar as the flow of the air caused by the first axial fan 2 is converted by the flow control device 4 into a flow of air with a whirl velocity component in the upstream direction with respect to the rotation direction of the second impeller 31.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A serial axial fan unit comprising:

a first impeller including a plurality of first blades arranged side-by-side in a circumferential direction and centered about a central axis, the first blades extending radially outward;

a first motor portion arranged to rotate the first impeller about the central axis;

a second impeller including a plurality of second blades arranged side-by-side in the circumferential direction and centered about the central axis, the second blades extending radially outward, the second impeller being arranged in series with the first impeller along the central axis;

a second motor portion arranged to rotate the second impeller about the central axis;

a flow control device arranged between the first impeller and the second impeller; and a housing arranged to surround the first impeller and the second impeller to define a path for a flow of air; wherein rotation of the first impeller and a rotation of the second impeller causes the air to flow in substantially the same direction;

the flow control device includes a plurality of flow control vanes, each of the flow control vanes having a first edge arranged on the first impeller side and a second edge arranged on the second impeller side, the first edge having a portion arranged downstream of the second edge with respect to a rotation direction of the second impeller;

the housing includes a first housing portion arranged to surround the first impeller, a second housing portion arranged to surround the second impeller, and a wind tunnel portion arranged to surround the plurality of flow control vanes;

the first motor portion is supported by the first housing portion by a plurality of first support ribs extending from the first motor portion radially outward and connected to the first housing portion;

the second motor portion is supported by the second housing portion by a plurality of second support ribs extending from the second motor portion radially outward and connected to the second housing portion;

each of the plurality of first support ribs has a surface directed upstream with respect to a rotation direction of the first impeller and being curved or slanted toward the second impeller with respect to a direction parallel or substantially parallel to the central axis; and the plurality of flow control vanes and the plurality of first support ribs are equal in number, and the first and second edges of each of the plurality of flow control vanes substantially overlap with each other in the direction parallel or substantially parallel to the central axis when viewed from a direction of the first impeller.

2. The serial axial fan unit according to claim 1, wherein each of the plurality of second support ribs has a surface directed upstream with respect to the rotation direction of the second impeller and being curved or slanted toward an opposite side to the second impeller with respect to a direction parallel or substantially parallel to the central axis.

3. The serial axial fan unit according to claim 1, wherein the flow control device includes a base portion concentric with the central axis, and the plurality of flow control vanes extend radially outward from the base portion and are connected to the wind tunnel portion arranged radially outward thereof.

4. The serial axial fan unit according to claim 1, wherein an end surface of the first housing portion on the wind tunnel portion side is substantially identical in shape to an end surface of the wind tunnel portion on the first housing portion side, and an end surface of the wind tunnel portion on the second housing portion side is substantially identical in shape to an end surface of the second housing portion on the wind tunnel portion side.

5. The serial axial fan unit according to claim 1, wherein the first impeller and the second impeller are arranged to rotate in the same direction.

6. The serial axial fan unit according to claim 1, wherein a rotation speed of the first impeller is substantially equal to or greater than a rotation speed of the second impeller.

7. A serial axial fan unit comprising:

a first impeller including a plurality of first blades arranged side-by-side in a circumferential direction and centered about a central axis, the first blades extending radially outward;

a first motor portion arranged to rotate the first impeller about the central axis;

a second impeller including a plurality of second blades arranged side-by-side in the circumferential direction and centered about the central axis, the second blades extending radially outward, the second impeller being arranged in series with the first impeller along the central axis;

a second motor portion arranged to rotate the second impeller about the central axis;

a flow control device arranged between the first impeller and the second impeller; and a housing arranged to surround the first impeller and the second impeller to define a path for a flow of air; wherein rotation of the first impeller and rotation of the second impeller causes the air to flow in substantially the same direction;

the flow control device includes a plurality of flow control vanes arranged to impart, to the flow of the air caused by the rotation of the first impeller, a flow velocity component in a direction opposite to a direction of the rotation of the second impeller;

the housing includes a first housing portion arranged to surround the first impeller, a second housing portion arranged to surround the second impeller, and a wind tunnel portion arranged to surround the plurality of flow control vanes;

the first motor portion is supported by the first housing portion by a plurality of first support ribs extending from the first motor portion radially outward and connected to the first housing portion arranged radially outward thereof;

the second motor portion is supported by the second housing portion by a plurality of second support ribs extending from the second motor portion radially outward and connected to the second housing portion arranged radially outward thereof;

each of the plurality of first support ribs has a surface directed upstream with respect to a rotation direction of the first impeller and being curved or slanted toward the second impeller with respect to a direction parallel or substantially parallel to the central axis; and the plurality of flow control vanes and the plurality of first support ribs are equal in number, and an edge of each of the plurality of flow control vanes on the first impeller side and an edge of the flow control vane on the second impeller side substantially overlap with each other in the direction parallel or substantially parallel to the central axis when viewed from a direction of the first impeller.

8. The serial axial fan unit according to claim 7, wherein each of the plurality of second support ribs has a surface directed upstream with respect to a rotation direction of the second impeller and being curved or slanted toward an opposite side to the second impeller with respect to a direction parallel or substantially parallel to the central axis.

9. The serial axial fan unit according to claim 7, wherein the flow control device includes a base portion substantially concentric with the central axis, and the plurality of flow control vanes extend radially outward from the base portion and are centered about the central axis, and are connected to the wind tunnel portion arranged radially outward thereof.

10. The serial axial fan unit according to claim 7, wherein an end surface of the first housing portion on the wind tunnel portion side is substantially identical in shape to an end surface of the wind tunnel portion on the first housing portion side, and an end surface of the wind tunnel portion on the second housing portion side is substantially identical in shape to an end surface of the second housing portion on the wind tunnel portion side.

11. The serial axial fan unit according to claim 7, wherein the first impeller and the second impeller are arranged to rotate in the same direction, and a rotation speed of the first impeller is equal to or greater than a rotation speed of the second impeller.

* * * * *